United States Patent [19]

Gelfand et al.

[11] Patent Number: 4,692,174

[45] Date of Patent: Sep. 8, 1987

[54] IONIZER ASSEMBLY HAVING A BELL-MOUTH OUTLET

[76] Inventors: Peter C. Gelfand, 56 Friar La., Trumbull, Conn. 06611; Walter V. Piulle, 960 Glennan Dr., Redwood City, Calif. 94061; Louis F. Rettenmaier, 8790 W. Jefferson Ave., Denver, Colo. 80235

[21] Appl. No.: 547,752

[22] Filed: Nov. 1, 1983

Related U.S. Application Data

[63] Continuation-in-part of Ser. No. 352,779, Feb. 26, 1982, abandoned, which is a continuation of Ser. No. 163,299, Jun. 26, 1980, abandoned.

[51] Int. Cl.[4] ..... B03C 3/12; B03C 3/40

[52] U.S. Cl. ..... 55/129; 55/117; 55/138; 361/226; 361/230

[58] Field of Search ..... 55/117, 120, 129, 138, 55/139, 150, 124, 131; 361/230, 226

[56] References Cited

U.S. PATENT DOCUMENTS

| | | | |
|---|---|---|---|
| 3,400,513 | 9/1968 | Boll | 55/138 |
| 3,966,435 | 6/1976 | Penney | 55/131 |
| 4,093,430 | 6/1978 | Schwab et al. | 55/117 |
| 4,108,615 | 8/1978 | Satterwaite | 55/117 |
| 4,216,000 | 8/1980 | Kofoid | 55/117 |
| 4,251,234 | 2/1981 | Chang | 55/129 |

OTHER PUBLICATIONS

Cobine, James; Gaseous Conductors Theory and Engineering Applications, 1958, pp. 177–180.

*Primary Examiner*—David L. Lacey

*Attorney, Agent, or Firm*—Flehr, Hohbach, Test, Albritton, & Herbert

[57] ABSTRACT

A high-intensity ionizer assembly having a Rogowski-shaped outlet. The ionizer assembly is adapted to be used with particle collection systems for pre-charging particulate matter entrained in a gas stream.

10 Claims, 5 Drawing Figures

IONIZER ASSEMBLY HAVING A BELL-MOUTH OUTLET

This is a continuation-in-part of application Ser. No. 352,779, filed Feb. 26, 1982, now abandoned, which is a continuation of application Ser. No. 163,299, filed June 26, 1980, now abandoned.

FIELD OF THE INVENTION

The present invention relates to high-intensity ionizers for pre-charging particulate matter entrained in a contaminated gas stream. More specifically, the invention is directed to an improved outlet configuration for a high-intensity ionizer.

BACKGROUND OF THE INVENTION

Standards for emissions of particulate in flue gases issuing from coal fired electrical power station stacks are becoming increasingly more stringent. Current air quality standards require that more than 99% of the fly ash produced by burning coal be removed prior to discharge of the combustion gases from the stack. Thus, the efficiency of particulate collection must increase in proportion to the ash content of the coal. In addition, in an effort to reduce the emission of certain gaseous pollutants, particularly the sulfur oxides, it has become increasingly necessary to use low sulfur coal in electrical power generating plants.

The electrostatic precipitator is a commonly used device for the removal of particulate matter from power station stack gases. Because the size of an electrostatic precipitator is determined by the efficiency of fly ash removal required, an increase in required fly ash collection efficiency required a corresponding increase in equipment size and cost. Moreover, because fly ash resistivity tends to be inversely related to the level of combustible sulfur in the coal burned, the use of low sulfur coals to directly reduce gaseous sulfur oxide emissions, produces highly resistive dusts. It has been demonstrated that the size of the electrostatic precipitator necessary to achieve a given level of collection efficiency increases with increasing electrical resistivity of the fly ash. The use of low sulfur coals therefore further increases the size and cost of the precipitator.

Recently, high-intensity ionizers have been developed in which a unique electrode geometry produces a stable high-intensity corona discharge through which the particulate-laden gas is passed. The ionized flue gases produced charge the particulate matter to a much higher level than is achievable with a conventional electrostatic precipitator. When the ionizer is followed with an electrostatic precipitator, the high particle charge results in a higher collection efficiency in the precipitator due to higher migration or particle drift velocity. In such a two-stage arrangement, the ionizer acts as the charging stage and the precipitator serves as the collecting stage.

Such high-intensity ionizers utilize a co-axial pair of electrodes to generate a high-intensity electric field expanding radially and axially with respect to the direction of gas flow. The anode in such an arrangement typically takes the form of a venturi diffuser through which the stack gases flow. The venturi diffuser typically includes an inlet, a throat section, a diffuser, and a metal or fiberglass expansion cone through which the gases flow immediately prior to entering the precipitator stage. The cathode may be a disk coaxially mounted within the venturi throat and is formed with a curved peripheral edge having a radius much smaller than the inner radius of the venturi diffuser. When a high voltage power supply is connected between the anode and cathode, a high-intensity corona discharge is established in the region between the arcuate periphery of the cathode disk and the surrounding tubular anode surface near the disk. Because the field is relatively narrow in the direction of gas flow, a high intensity electric field is achievable without prohibitive power requirements. The combination of the high gas stream velocity through the venturi and the high intensity transverse electric field through which the gas stream passes produces intense ionization and very high levels of charge on the particles and results in increased collection efficiency notwithstanding the high resistivity of the particulate as in the case of fly ash from low sulfur coal.

One of the problems which has been encountered in connection with co-axial high intensity ionizers of the type described above results from the detrimental build-up of charged particles on the anode wall near the corona discharge plane. Deposition of high resistivity particulate matter in this region results in the phenomena of back corona and excessive sparking with a resulting deterioration in the electrical field and degradation in particle charge. Prior attempts, see U.S. Pat. No. 4,093,430, issued June 6, 1978, to overcome this problem have involved "cleaning" the anode surface in the affected region to eliminate disturbances in the corona due to contaminant build-up on the outer electrode. This cleaning has been accomplished by injecting water or similar fluid onto the surface of the converging cone section of the venturi wall. U.S. Pat. No. 4,108,615 issued Aug. 22, 1978, discloses another approach to the deposition problem. Here the venturi diffuser has a vaned anode through which clean gas from an external source is introduced into the venturi throat section to form a clean gas protective barrier along the interior anode surface.

Another problem which has limited performance of the high-intensity ionizer/precipitator arrangement has been the formation of back corona at certain geometric interfaces within the ionizer assembly. Particularly, particle discharge, which causes back corona, was found to occur at the interface between the diffuser and fiberglass expansion cone of the venturi diffuser and at the outlet of the expansion cone. There are several possible causes for this back corona including a buildup of particulate matter and/or the existence of sharp edges and small protuberances at the above-described locations within the ionizer, the change in dielectric properties at the interface of the metallic diffuser and the fiberglass expansion cone, and/or the existence of high electric fields, and possibly edge effects, in or at the outlet of the expansion cone. The present invention is designed to eliminate the formation of back corona at these interfaces by replacing the diffuser and expansion cone with a unique ionizer assembly outlet section.

SUMMARY OF THE INVENTION

According to the present invention, the undesirable effects of particle discharge occurring at certain locations within the ionizer assembly are eliminated by replacing the diffuser and expansion cone with an outlet shaped so as to maintain the electric fields at the outlet surface less than the electric fields occurring within the throat section of the ionizer thus avoiding undesirable particle discharges. This outlet profile is similar to a Rogowski shape. The ionizer assembly of the present invention includes a central throat section, a conical inlet section tapering inwardly toward the central throat section, and a conical outlet section tapering outwardly from the throat section. The inlet is connected to a source of particulate-laden gases and the outlet may be connected to an electrostatic precipitator or other particle collecting means. The surface profile of the outlet is constructed so that its curved portion corresponds to an equipotential surface having a normalized value between $\pi/2$ and $\frac{2}{3}\pi$. A discharge electrode is positioned within the central throat section to define an electrode gap therebetween. A high voltage power supply is connected across the throat section and the discharge electrode to establish a high-intensity electric field within the electrode gap. This imparts a charge to the particles in the particulate-laden gases flowing therethrough.

The Rogowski-shaped outlet, due to its geometric configuration, prevents the formation of back corona that was found to occur at certain points downstream of the throat section of prior art venturi diffusers. This has increased the collection efficiency of the ionizer/-precipitator.

DETAILED DESCRIPTION OF THE PREFERRED EMBODIMENT

Figure 1:
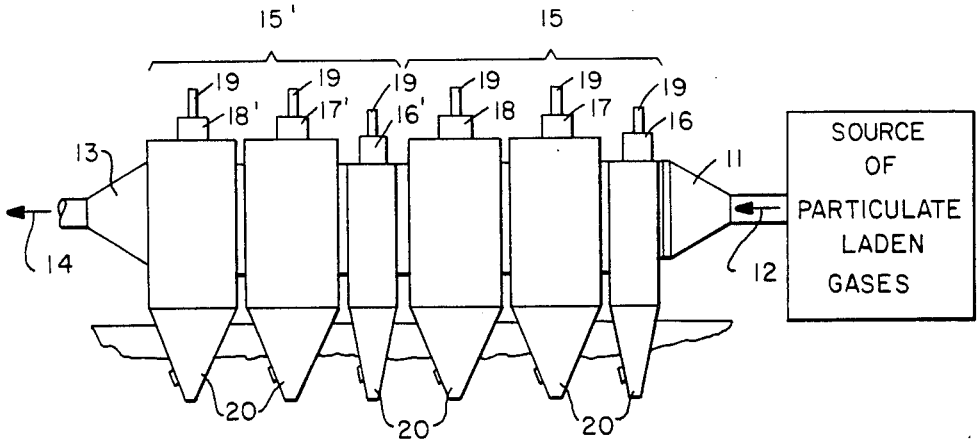
FIG. 1 is a schematic side elevational view illustrating a multi-stage electrostatic precipitator incorporating a high-intensity ionizer according to the present invention.

Turning now to the drawings, FIG. 1 shows in schematic side elevational view an electrostatic precipitator system incorporating the invention. As seen in this figure, the precipitator system includes a gas inlet 11 into which gases to be cleaned are directed as suggested by arrow 12, a gas outlet 13 from which cleaned gases are supplied to appropriate downstream apparatus, e.g., an atmospheric discharge duct, as suggested by arrow 14, and typically a cascaded pair of ionizer-precipitator units generally designated by reference numerals 15, 15'. Each ionizer-precipitator unit 15, 15' includes an ionizer stage 16, 16' and typically a pair of conventional electrostatic precipitators 17, 18, 17', 18'. Each ionizer stage 16, 16' and precipitator stage 17, 17', 18, 18' is provided with a high voltage input connector 19 coupled to a suitable supply of high voltage, and a collecting bin portion 20 for collecting particulate matter precipitated from the gas as the latter flows through units 15, 15'.

In operation, gases containing particulate matter enter the FIG. 1 apparatus via inlet 11 and pass through the first ionizer stage 16 in which the particles in the gas are electrostatically charged. The gas bearing the electrostatically charged particles next flows into successive precipitator stages 17, 18 in each of which the charged particles are deflected out of the flow path of the gas under the influence of an electrical field established across the flow path, the particles being deposited in the bin portion 20 of the precipitator stages 17, 18. The gas exiting from precipitator 18 is passed through ionizer stage 16' and precipitator stages 17', 18' to provide additional cleaning therefor, and the cleaned gases emerging from precipitator stage 18' are conducted via gas outlet 13 to appropriate downstream apparatus.

Figure 2:
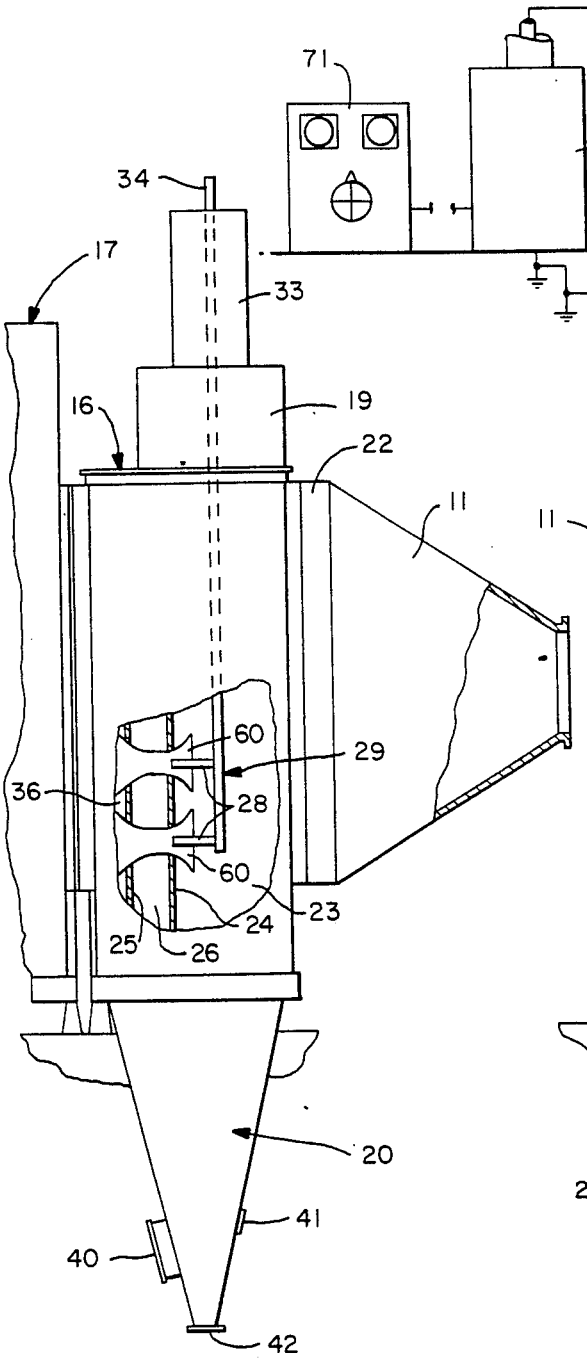
FIG. 2 is an enlarged side view of one ionizer stage of the apparatus of FIG. 1 partially broken away to show the ionizer array.
Figure 3:
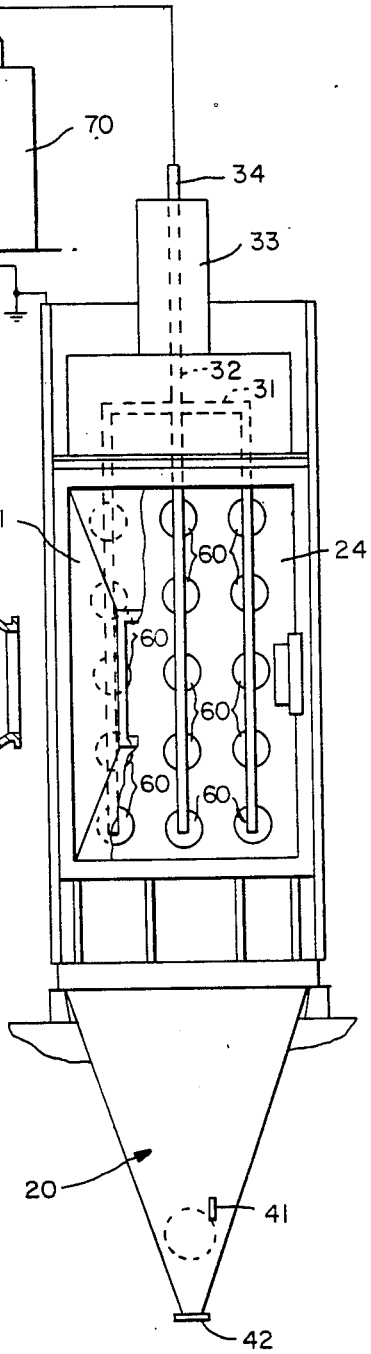
FIG. 3 is an end elevational view of the ionizer stage of FIG. 2 with the inlet partially broken away to show the ionizer array.

FIGS. 2 and 3 typically illustrate the gas inlet 11 and the first ionizer stage 16 with more detail. As shown, gas inlet 11 comprises a hollow conduit of trapezoidal or other suitable shape which is coupled at the downstream side to a gas distributor portion 22. Distributor portion 22 is coupled to an entry chamber 23 formed within the housing of ionizing unit 16 by the side and bottom walls thereof and a vertically arranged bulkhead 24. Bulkhead 24 and a second vertically arranged bulkhead 25 define with the side, top and bottom walls of ionizer stage 16 a pressure manifold 26.

Positioned within ionizer stage 16 in a regular array are a plurality of venturi units 60 and associated central electrode support members 28. A respective member 28 projects into the upstream side of a respective unit 60 in substantial coaxial relationship therewith. Each member 28 is coupled to a bus bar network generally designated by reference numberal 29 and consisting of vertically arranged parallel bus bars, of which three are shown, interconnected at the upper ends thereof by a common bus bar element 31. The element 31 is connected to a single bus bar element 32 extending from the interior of ionizer stage 16 to an external conventional high voltage connector shroud 33 to which a high voltage is supplied from a suitable power source, such as a conventional transformer rectifier set 70 and control unit 71, via high voltage connector 34. The downstream end or outlet of each venturi unit 60 is coupled to an exit chamber 36 which is in turn coupled to the inlet of electrostatic precipitator stage 17.

Storage bin 20 is provided with a removable door 40 for purposes of inspection and cleaning, and a vibrator bracket 41 for permitting the use of an optional conventional vibrator to assist in settling any particulate matter collecting in bin 20 towards the bottom edge 42 thereof. Bottom edge 42 is provided with suitable apertures, not shown, for enabling the particulate matter to be removed from the bin 20 in a conventional manner. Bins 20 of the remaining system elements 16', 17, 17', 18 and 18' are configured in a substantially identical manner.

Each venturi unit 60 and associated member 28 generally comprises an electrode pair for generating a high intensity electric field across the path of gas flow through the ionizer stage 16. To this purpose, an electrode, described below, is carried by each member 28 and is coupled to a source of relatively high negative potential via bus bar network 29. Each venturj unit 60 is coupled via the framework of the structure to ground potential. Thus each venturi unit 60 serves as an anode and each member 28 serves as a cathode support. In operation, with high voltage applied between the cathode, the inner electrode, and anode, the outer electrode, particles suspended in any gas flowing through the ionizer stage 16 are electrostatically charged when passing through the throat section, described below, of venturi unit 60.

Figure 4:
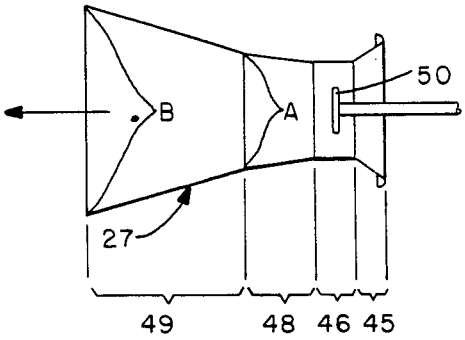
PRIOR ART FIG.—4
FIG. 4 is an enlarged partial sectional view of an ionizer venturi diffuser of the type used heretofore.

As discussed previously, the particle collection efficiency of the ionizer/precipitator was being limited by the formation of back corona at key geometric interfaces within the ionizer assembly. This problem and the solution to the problem achieved by the present invention is best illustrated by reference to FIG. 4. FIG. 4 illustrates a venturi diffuser 27 of the type used theretofore in which the above-described problem was found to limit ionizer/precipitator performance. Each venturi diffuser 27 is formed with an inwardly tapering conical inlet section 45, a generally cylindrical throat section 46, a diffuser section 48, and a fiberglass or metal expansion cone 49. The cathode includes a conducting disk 50 which projects outwardly from an appropriate support member. At the geometric interface between diffuser 48 and expansion cone 49, which is represented by letter A, and the outlet of expansion cone 49, which is represented by letter B, particle discharge was found to be constraining ionizer performance. This occurred because the electric field was being concentrated at the boundary of the expansion cone which tended to produce charge-limiting corona discharges at locations A and B. To prevent this problem, the present invention is directed to a unique ionizer outlet configuration which replaces diffuser section 48 and expansion cone 49.

Figure 5:
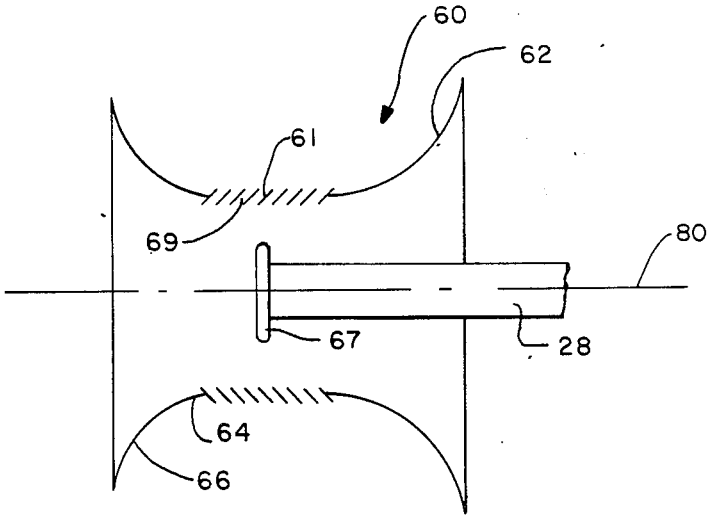
FIG. 5 is an enlarged partial sectional view illustrating the improved venturi unit of the present invention.

With reference to FIG. 5, the ionizer assembly of the present invention is illustrated. As noted above, it comprises a venturi unit 60—which is distinguished from a venturi diffuser (FIG. 4) which includes a diffuser section and expansion cone—that includes a metallic, bell-mouth-shaped inlet section 62, a metallic, central throat section 64, and a metallic bell-mouth-shaped outlet section 66. More specifically, venturi unit 60 is formed with an inwardly tapering conical inlet 62, a generally cylindrical throat 64, and an outwardly tapering conical outlet 66. Conical electrode 66 diverges from throat 64 such that the surface profile of the curved portion thereof forms a Rogowski surface, that is, it has a Rogowski shape.

The Rogowski surface is derived from Maxwell's analysis of the electric field between two parallel semi-infinite planes charged to different potentials wherein the field between the planes is symmetrical about an axis midway therebetween. See *Treatise on Electricity and Magnetism,* Vol. I, p. 309, 3ed., 1982. Maxwell's analysis is expressed by the equations $$x=A\,(\phi+e^{\phi}\cos\Psi)$$

$$y=A\,(\Psi+e^{\phi}\sin\Psi)$$

where $\Psi$ represents the equipotential surfaces and $\phi$ the electrical lines of force between the two planes, A is a constant, and x and y are the coordinates. From this analysis, it is found that for the equipotential surfaces $\pi/2 \leqq \Psi \leqq \frac{2}{3}\pi$, where $\Psi$ is a normalized or dimensionless value, the electric field is at no point greater than it is for the uniform region between the two planes. An electrode having a Rogowski surface is one formed so that the profile of its curved portion is the same as that of any equipotential surface $\Psi$ between $\pi/2$ and $\frac{2}{3}\pi$. Sparking will then always occur between the plane portion of such electrodes. In practice, a close approximation to a Rogowski surface for a plane electrode may be achieved by revolving an equipotential line of a cross-section of the electrode about a central axis perpendicular to the plane electrode so as to form a circular section having a plane central section and a curved (Rogowski) outer portion. See J. Cobine, "*Gaseous Conductors: Theory and Engineering Applications*", Chapter 7, Section 7.12, p. 177 (1941), which is hereby incorporated by reference.

As illustrated in FIG. 5, outlet 66 comprises a conical or horn-shaped surface formed by rotating a Rogowski curve about the central axis 80 of venturi unit 60. The curved portion of outlet 66 corresponds in configuration to the equipotential surface having a normalized value of between $\pi/2$ and $\frac{2}{3}\pi$. For example, the curving surface of outlet 66 may have a surface profile corresponding to an equipotential surface having a normalized value of $7/12\pi$.

Because of the gradually curving surface of the Rogowski surface, a build-up of the electric field downstream of the throat to a value greater than that along the central portion of the venturi unit is prevented. This reduces particle discharge. The surface profile of inlet 62 will also typically be that of a Rogowski surface, that is, inlet 62 comprises a conical surface formed by rotating a Rogowski curve about the central axis 80. The curved portion of inlet 62 therefore corresponds in configuration to an equipotential surface having a normalized value of between $\pi/2$ and $\frac{2}{3}\pi$.

The ionizer assembly further includes an inner electrode or conducting disk 67 that has a curved peripheral edge which projects outwardly from member 28. Disk 67 may be positioned substantially coaxially in throat 64 along central axis 80 to define an electrode gap. The disk provides a highly constricted high-intensity electric field in the form of a corona discharge between the curved periphery of the disk and the surrounding anode surface 69 when a high potential is applied.

The ionizer assembly may further include a series of flanged conical vanes 61 formed in anode surface 69 in communication with injection means to introduce particulate-free gas—purged air—into the throat to prevent the deposition of charged particles on the inner surfaces of the venturi units. This system is disclosed in detail in U.S. Pat. No. 4,108,615, issued Aug. 22, 1978, and assigned to the assignee of the present invention, and which disclosure is hereby incorporated by reference.

While a preferred embodiment of the present invention has been described above, it will be readily apparent to those skilled in the art that various adaptions and modifications thereof can be made without departing from the spirit and scope of the invention as defined by the claims. For example, some other collecting means, such as a set scrubber or fabric filter, might be used in place of the electrostatic precipitator, or the configuration of the cathode might be varied.

What is claimed is:

1. A high-intensity ionizer assembly, comprising:

a venturi unit having an inlet connected to a source of particulate-laden gases, an outlet of a Rogowski shape, and a central throat section formed intermediate of said inlet and outlet; and means for establishing a high-intensity electric field within said throat section wherein said electric field extends across the path of the particulate-laden gases flowing therethrough to charge the particles therein.

2. The high-intensity ionizer of claim 1 wherein said outlet is connected to an electrostatic precipitator.

3. The high-intensity ionizer of claim 2 wherein there are a plurality of said venturi units arranged in an array with their longitudinal axes aligned and their inlets communicating with a common gas distribution manifold connected to the source of particulate-laden gases.

4. A high-intensity ionizer assembly, comprising:

a central throat section;

a conical inlet section tapering inwardly to said throat section, said inlet connected to a source of particulate-laden gases;

a conical outlet section tapering outwardly from said throat section and having a surface profile forming a Rogowski surface;

an electrode positioned within said throat section to define an electrode gap therebetween; and means for applying a high voltage across said throat section and said electrode to establish a high-intensity electric field within said electrode gap to charge the particles in the particulate-laden gases flowing therethrough.

5. The high-intensity ionizer assembly of claim 4 wherein the tapering outwardly portion of the surface of said outlet section corresponds in configuration to a curved portion of an equipotential surface having a normalized value of between $\pi/2$ and $\frac{2}{3}\pi$.

6. The high-intensity ionizer assembly of claim 5 wherein said inlet section has a surface profile that forms a Rogowski surface.

7. The high-intensity ionizer assembly of claim 4 wherein said outlet section is connected to a means for collecting the charged particles.

8. A high-intensity ionizer assembly, comprising:

a substantially tubular housing for the flow of particulate-laden gases therethrough wherein at least a portion of the interior walls of said housing serves as an ionizer anode, said housing including, (i) an inwardly tapering conical inlet section connected to a source of particulate-laden gas, (ii) an outwardly tapering conical outlet section having a surface profile that corresponds to a Rogowski surface, and (iii) a central throat section intermediate of said inlet section and said outlet section;

a discharge electrode coaxially positioned within said throat section of said housing to serve as an ionizer cathode; and means for applying a high voltage between said cathode and said anode to establish a high-intensity electric field in the region between said discharge electrode and the interior walls of said housing.

9. A high-intensity ionizer for use with a particle collecting means comprising:

a venturi unit having an inlet adapted to be connected to a source of particulate-laden gases, an outlet adapted to be connected to the particle collecting means and having a surface profile that corresponds in configuration to an equipotential surface having a normalized value of $\pi/2$ and $\frac{2}{3}\pi$, and a central throat section formed intermediate of said inlet and outlet; and means for establishing a high-intensity electric field within said throat section wherein said electric field extends across the path of the particulate-laden gases flowing therethrough to charge the particles therein.

10. A high-intensity ionizer for use with a particle collecting means, comprising:

a substantially tubular outer electrode for the flow of particulate-laden gases therethrough, said outer electrode including, (i) a throat region, (ii) an inlet having a converging sidewall upstream of said throat region, said inlet adapted to be connected to a source of particulate-laden gases, and (iii) an outlet adapted to be connected to the particle collecting means and having a diverging and curving sidewall downstream of said throat region wherein the curving portion of the sidewall of said outlet corresponds in configuration to the curved portion of an equipotential surface having a normalized value of between $\pi/2$ and $\frac{2}{3}\pi$;

an inner electrode coaxially positioned within said outer electrode to define an electrode gap therebetween; and means for applying a high voltage across said electrodes for establishing a high-intensity corona discharge within said electrode gap to charge the particles in the particulate-laden gases moving therethrough.

* * * * *

UNITED STATES PATENT AND TRADEMARK OFFICE

CERTIFICATE OF CORRECTION

PATENT NO. : 4,692,174

DATED : September 8, 1987

INVENTOR(S) : Gelfand, et al.

It is certified that error appears in the above—identified patent and that said Letters Patent is hereby corrected as shown below:

At Col. 3, ln. 23, after "ionizer/" delete "-".

At Col. 4, ln. 28, rewrite "numberal" to read --numeral--.

At Col. 6, ln. 48, change "set" to read --wet--.

Signed and Sealed this

Nineteenth Day of April, 1988

*Attest:*

DONALD J. QUIGG

*Attesting Officer*

*Commissioner of Patents and Trademarks*